US005274977A

United States Patent [19]

Bayly

[11] Patent Number: 5,274,977

[45] Date of Patent: Jan. 4, 1994

[54] DECKING SYSTEM

[76] Inventor: David H. Bayly, 29 E. Papa St., Hahului, Hi. 96732

[21] Appl. No.: 937,557

[22] Filed: Aug. 31, 1992

[51] Int. Cl.[5] ..... E04B 9/00

[52] U.S. Cl. ..... 52/480; 52/87; 52/180; 52/391; 296/182

[58] Field of Search ..... 52/87, 180, 177, 390, 52/391, 392, 480; 296/181, 182

[56] References Cited

U.S. PATENT DOCUMENTS 4,051,639 10/1977 Lombardi ..... 52/177
4,526,418 7/1985 Martin ..... 296/182
4,838,605 6/1989 Abromavage ..... 296/182
4,947,595 8/1990 Douds ..... 52/177
5,009,045 4/1991 Yoder ..... 52/177

*Primary Examiner*—Carl D. Friedman
*Assistant Examiner*—Beth A. Aubrey
*Attorney, Agent, or Firm*—Michael I. Kroll

[57] ABSTRACT

An improved decking system is provided for an exterior deck extending from one side of a building. The exterior deck has a header around its periphery, a railing on the header and a plurality of joists spaced apart in parallel relationships between the header. The improvement consists of a plurality of plastic flooring members extending in slightly spaced apart parallel relationships transversely across the joists.

4 Claims, 2 Drawing Sheets

DECKING SYSTEM

BACKGROUND OF THE INVENTION

1. Field of the Invention

The instant invention relates generally to house decks and more specifically it relates to an improved decking system.

2. Description of the Prior Art

Numerous house decks have been provided in prior art that are adapted to contain wooden horizontal floors raised above the level of adjacent ground areas, which project from the sides of building structures to be utilized for dining and recreation. While these units may be suitable for the particular purpose to which they address, they would not be as suitable for the purposes of the present invention as heretofore described.

SUMMARY OF THE INVENTION

A primary object of the present invention is to provide an improved decking system that will overcome the shortcomings of the prior art devices.

Another object is to provide an improved decking system that utilizes E-shaped plastic channel flooring members that will never rot, crack, cup, mildew, stain, splinter or be eaten by termites as in wood flooring members.

An additional object is to provide an improved decking system in which the E-shaped plastic channel flooring members never need to be painted, stained or treated with water sealant to protect it from the elements to prolong its life.

A further object is to provide an improved decking system that is simple and easy to use.

A still further object is to provide an improved decking system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
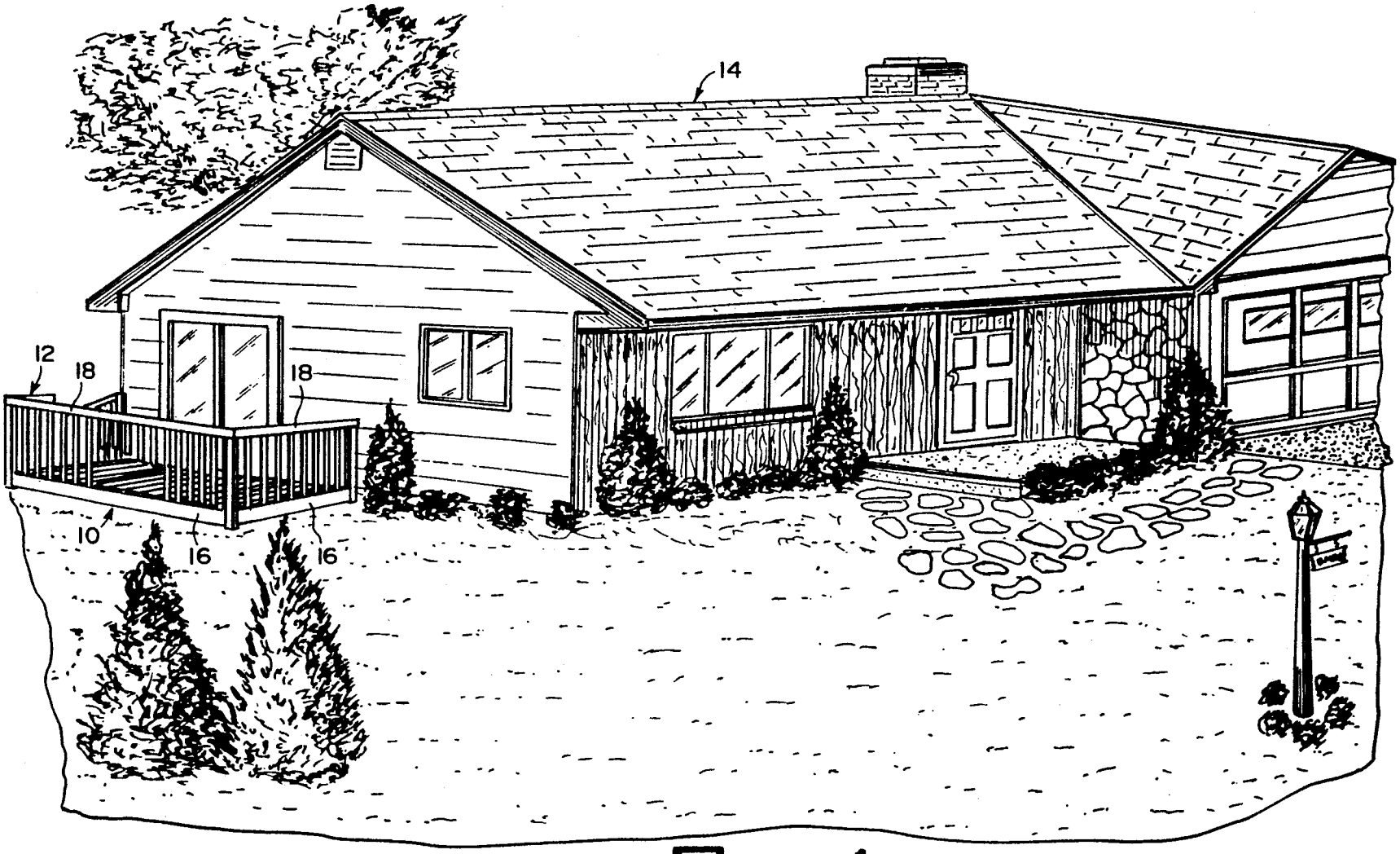
FIG. 1 is a perspective view of a housing with an exterior deck attached thereto with the instant invention installed on the exterior deck.
Figure 2:
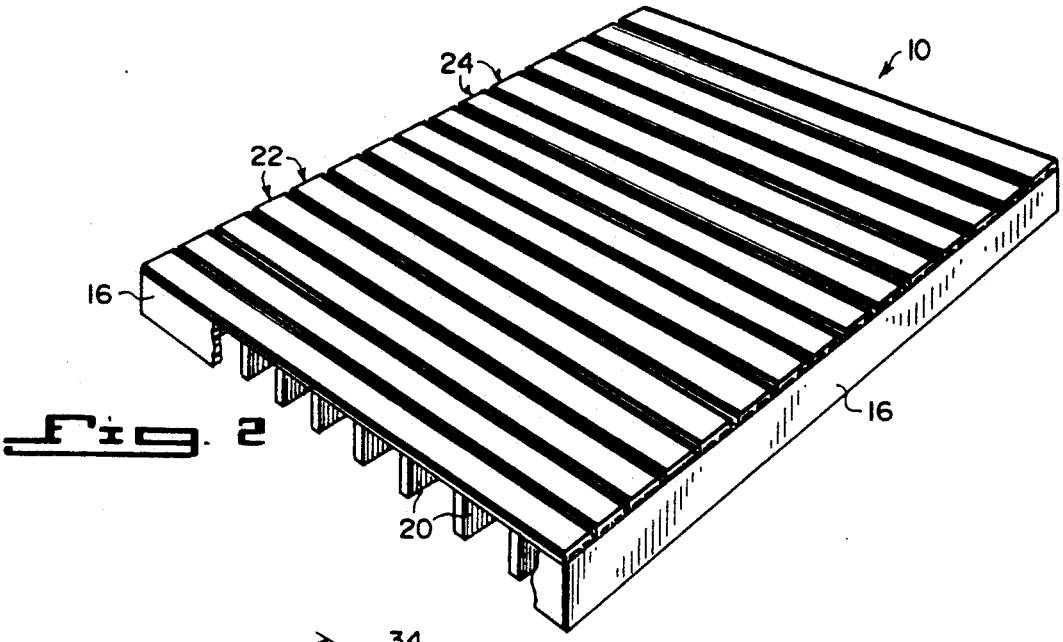
FIG. 2 is a perspective view of just the exterior deck with parts broken away.
Figure 3:
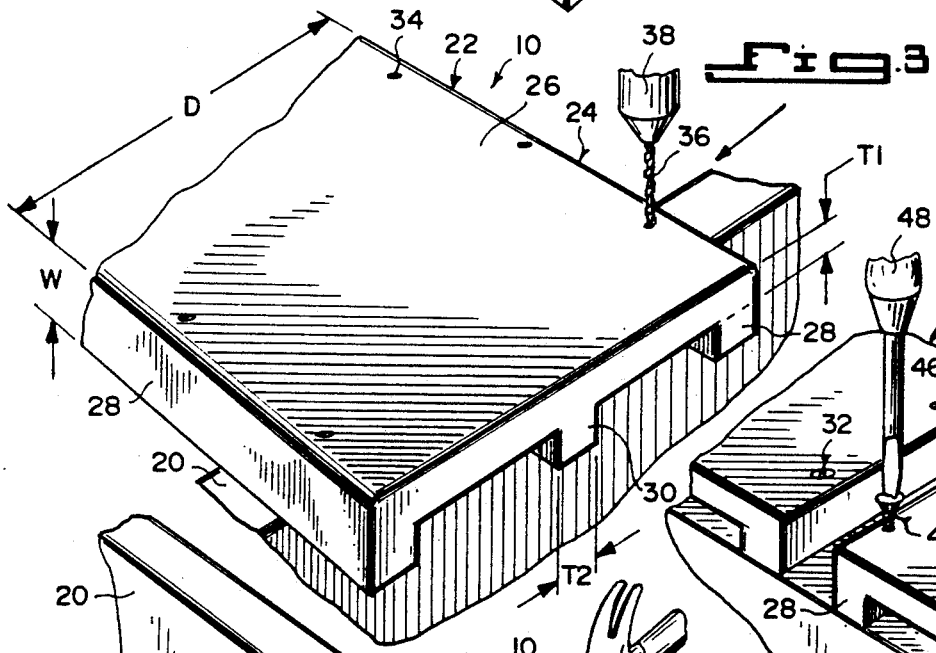
FIG. 3 is a perspective view showing one of the flooring members being pre-drilled with pilot holes along its longitudinal ends.

Turning now descriptively to the drawings, in which similar reference characters denote similar elements throughout the several views, the Figures illustrate an improved decking system 10 for an exterior deck 12 extending from one side of a building 14. The exterior deck 12 has a header 16 around its periphery, a railing 18 on the header and a plurality of joists 30 spaced apart in parallel relationships between the header 15. The improvement consists of a plurality of plastic flooring members 22 extending in slightly spaced apart parallel relationships transversely across the joists 20.

Each plastic flooring member 22 is an elongated E-shaped channel 24 to give extra strength thereto when placed transversely across the joists 20. Each elongated E-shaped channel 24 includes a web portion 26, a pair of end flange portions 28 and a central flange portion 30.

The depth "D" of the web portion 26 of the E-shaped channel 24 is typically but not limited to a dimension of five and one half inches. The width "W" of each end flange portion 28 and the central flange portion 30 of the E-shaped channel 24 is typically but not limited to a dimension of three quarters of an inch. The thickness "T1" of the web portion 26 of the E-shaped channel 24 is typically but not limited to a dimension of three eights of an inch. The thickness "T2" of each end flange portion 28 and the central flange portion 30 of the E-shaped channel 24 is typically but not limited to a dimension of three eights of an inch.

The improved decking system 10 further includes a structure 32 for securing each of the E-shaped channels 24 to the tops of the joists 20 when placed transversely across the joists 20. The securing structure 32 consists of each E-shaped channel 24 having a plurality of spaced apart pilot holes 34 drilled through each end flange portion 28 by a bit 36 of a drill 38. A plurality of fasteners 40 are provided, with each driven through each pilot hole 34 in each E-shaped channel 24 and into one of the joists 20.

Figure 5:
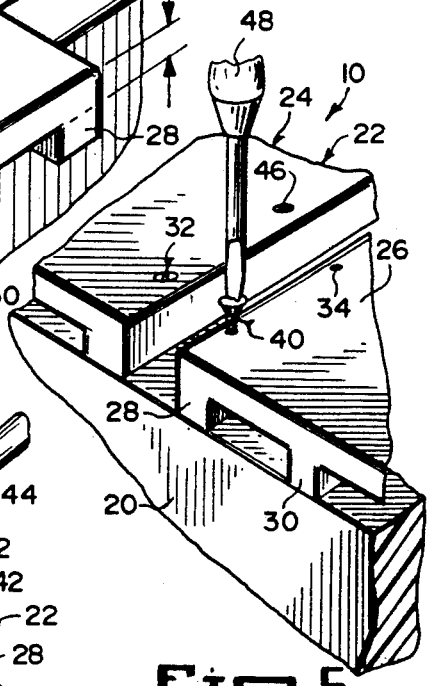
FIG. 5 is a perspective view showing one of the flooring members being secured to one of the joists by screws.
Figure 4:
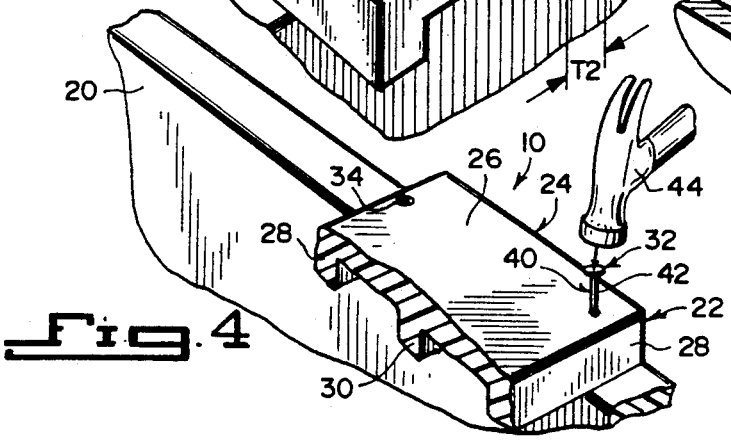
FIG. 4 is a perspective view showing one of the flooring members being secured to one of the joists by nails hammered through the pilot holes.

Each fastener 40, as shown in FIG. 4, is a nail 42 that is driven into each pilot hole 34 in each E-shaped channel 24 and into one of the joists 20 by a hammer 44. Each fastener 40, as shown in FIG. 5, is a screw 46 that is driven into each pilot hole 34 in each E-shaped channel 24 and into one of the joists 20 by a screwdriver 48.

The improved decking system 10 replaces wooden decking used in exterior decks, docks and piers. It is installed like the wooden decking except that it will never rot, crack, cup, mildew, stain, splinter or be eaten by termites.

The plastic flooring members 22 never need to be painted, stained or treated with water sealant to protect them from the elements to prolong their life. They can be easily washed and can have textured surfaces, so they will not be slippery when wet.

The E-shaped channels 24 can be manufactured in any color and made to look like wood. They cannot be damaged by ultra violet rays or by hot and cold temperatures. The most important feature of the instant invention is that the E-shaped channels 24, once installed to the joists 20, will never need to be replaced.

LIST OF REFERENCE NUMBERS

10: improved decking system
12: exterior deck
14: building
16: header
18: railing
20: joist
22: plastic flooring member
24: elongated E-shaped channel for 22

26: web portion of 24
28: end flange portion of 24
30: central flange portion of 24
32: securing structure
34: pilot hole
36: bit
38: drill
40: fastener
42: nail for 40
44: hammer
46: screw
48: screwdriver
D: depth of 26
W: width of 28 and 30
T1: thickness of 26
T2: thickness of 28 and 30

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved decking system for an exterior deck extending from one side of a building, the exterior deck having a header around its periphery, a railing on the header and a plurality of joists spaced apart in parallel relationships between the header, wherein the improvement comprises a plurality of plastic flooring members extending in slightly spaced apart parallel relationships transversely across the joists, each said plastic flooring member is an elongated E-shaped channel to give extra strength thereto when placed transversely across the joists, each said elongated E-shaped channel includes a web portion, a pair of end flange portions and a central flange portion, said pair of end flange portion and said central flange portion are all of the same thickness and wide enough for securing means, said securing means includes each said E-shaped channel having a plurality of spaced apart pilot holes drilled through each said end flange portion by a bit of a drill and a plurality of fasteners, each driven through each said pilot hole in each said E-shaped channel and into one of the joists.

2. An improved decking system for an exterior deck as recited in claim 1, further including means for securing each of said E-shaped channels to the tops of the joists when placed transversely across the joists.

3. An improved decking system for an exterior deck as recited in claim 2, wherein each said fastener is a nail that is driven into each said pilot hole in each said E-shaped channel and into one of the joists by a hammer.

4. An improved decking system for an exterior deck as recited in claim 2, wherein each said fastener is a screw that is driven into each said pilot hole in each said E-shaped channel and into one of the joists by a screwdriver.

* * * * *